US010477895B2

(12) United States Patent
Wang et al.

(10) Patent No.: US 10,477,895 B2
(45) Date of Patent: Nov. 19, 2019

(54) ELECTRONIC CIGARETTE ATOMIZER

(71) Applicant: O-NET AUTOMATION TECHNOLOGY (SHENZHEN) LIMITED, Shenzhen, Guangdong (CN)

(72) Inventors: Feng Wang, Guangdong (CN); Cheng Wang, Guangdong (CN); Fei Shen, Guangdong (CN)

(73) Assignee: O-NET AUTOMATION TECHNOLOGY (SHENZHEN) LIMITED, Shenzhen (CN)

( * ) Notice: Subject to any disclaimer, the term of this patent is extended or adjusted under 35 U.S.C. 154(b) by 558 days.

(21) Appl. No.: 15/270,014

(22) Filed: Sep. 20, 2016

(65) Prior Publication Data

US 2017/0006922 A1 Jan. 12, 2017

Related U.S. Application Data

(63) Continuation of application No. PCT/CN2015/072311, filed on Feb. 5, 2015.

(51) Int. Cl.

| | |
|---|---|
| ***A24F 47/00*** | (2006.01) |
| ***H05B 3/46*** | (2006.01) |
| ***H05B 3/04*** | (2006.01) |

(52) U.S. Cl.

CPC ..... *A24F 47/008* (2013.01); *H05B 3/04* (2013.01); *H05B 3/46* (2013.01);

(Continued)

(58) Field of Classification Search

CPC ..... H05B 3/04; H05B 2203/014; H05B 2203/021; H05B 2203/022; H05B 3/46; A24F 47/008

(Continued)

(56) References Cited

U.S. PATENT DOCUMENTS

2013/0319407 A1* 12/2013 Liu ..... A61M 15/06 128/202.21
2015/0117842 A1* 4/2015 Brammer ..... H05B 3/02 392/387

(Continued)

FOREIGN PATENT DOCUMENTS

CN 103960781 A * 8/2014 ..... A24F 47/008
CN 103960781 A 8/2014

(Continued)

OTHER PUBLICATIONS

International Search Report of PCT Patent Application No. PCT/CN2015/072311 dated Sep. 22, 2015.

*Primary Examiner* — Dana Ross
*Assistant Examiner* — Kuangyue CHen

(57) ABSTRACT

An e-cigarette atomizer, and an atomizing assembly (30) thereof comprising: a holding frame (31) having an air channel in communication with a flue (202) and an end surface slot for accommodating a heating module (32); and the heating module (32) having a ceramic base body (321) and heating wires (322) wound on the ceramic base body (321). The heating wires (322) are electrically connected to the holding frame (31), and the ceramic base body (321) is a hollow microporous structure and is in communication with a liquid storage cavity (201). As a result of the design of an electrically conductive outer holding frame (313) and inner holding frame (311), the heating module (32) abuts and is electrically connected to the outer holding frame (313) and the inner holding frame (311) respectively; thereby, the structure is simplified and stability is improved.

10 Claims, 4 Drawing Sheets

(52) U.S. Cl.
CPC .. *H05B 2203/014* (2013.01); *H05B 2203/021* (2013.01); *H05B 2203/022* (2013.01)

(58) Field of Classification Search
USPC ..... 392/404
See application file for complete search history.

(56) References Cited

U.S. PATENT DOCUMENTS

| | | | | |
|---|---|---|---|---|
| 2015/0282528 | A1* | 10/2015 | Liu | A61M 15/06 131/329 |
| 2016/0331030 | A1* | 11/2016 | Ampolini | A24F 47/008 |
| 2017/0006922 | A1* | 1/2017 | Wang | H05B 3/04 |
| 2018/0037089 | A1* | 2/2018 | Baek | B60H 1/00392 |

FOREIGN PATENT DOCUMENTS

| | | | | |
|---|---|---|---|---|
| CN | 104161308 A | * | 11/2014 | A24F 47/00 |
| CN | 104161308 A | | 11/2014 | |

* cited by examiner

ELECTRONIC CIGARETTE ATOMIZER

CROSS-REFERENCE TO RELATED APPLICATIONS

The present application is a Continuation Application of PCT application No. PCT/CN2015/072311 filed on Feb. 5, 2015, the contents of which are hereby incorporated by reference.

TECHNICAL FIELD

The present invention relates to the technical field of electronic cigarettes, and in particular to an electronic cigarette atomizer.

BACKGROUND

An electronic cigarette, also called an e-cigarette, is mainly used for smoking cessation and used as an alternative to cigarettes. The electronic cigarette is similar to a cigarette in appearance and smell, but generally does not contain tar, suspended particulates and other harmful components as contained in the cigarette, thereby producing no pervasive or swirling second-hand smoke.

The electronic cigarette mainly consists of an atomizer and a power supply assembly. The atomizer generally comprises a liquid storage cavity, a heating wire, a heating wire support body (a liquid absorbing rope), positive and negative atomizer electrodes and the like. In a common electronic cigarette, the heating wire is wound on the heating wire support body to form a heating element. Therein, two ends of the heating wire are electrically connected with the positive and negative atomizer electrodes via through holes in a holding frame to implement heating operation.

However, the connecting manner of the heating element leads to instability in energization. Specifically, it is troublesome to mount the heating wire and the positive and negative atomizer electrodes. The electronic cigarette atomizer is complicated in structure and inconvenient for fully-automatic production of the electronic cigarette atomizer.

SUMMARY

A technical problem to be solved by the present invention is to overcome the above deficiencies in the prior art and provide an electronic cigarette atomizer, which is strong in stability, simple in structure and convenient for automatic production.

A technical solution employed by the present invention to solve the technical problem thereof is to provide an electronic cigarette atomizer. The comprising an atomizing assembly, a smoke duct and a cigarette holder, the smoke duct comprising a liquid storage cavity for storing tobacco liquid and a flue, and being in a fitted mounting respectively with the atomizing assembly and the cigarette holder, wherein the atomizing assembly comprises:

a holding frame, comprising an air channel communicated with the flue and end-surface slots for accommodating a heating module; and the heating module, comprising a ceramic base body and a heating wire wound on the ceramic base body, wherein the heating wire is electrically connected with the holding frame, and the ceramic base body is of a hollow micropore structure and is communicated with the liquid storage cavity.

Therein, a preferred solution is as follows: the holding frame comprises an outer holding frame, a middle holding frame and an inner holding frame, the outer holding frame and the inner holding frame being conductive holding frames, and the middle holding frame being an insulating holding frame and nested between the outer holding frame and the inner holding frame for insulating and isolating the outer holding frame and the inner holding frame and sealing the liquid storage cavity.

Therein, a preferred solution is as follows: two ends of the heating wire are electrically connected with the outer holding frame and the inner holding frame respectively, and the outer holding frame and the inner holding frame are provided with opposite electrodes.

Therein, a preferred solution is as follows: the end-surface slots are respectively disposed at two sides of an end-surface for the outer holding frame, the middle holding frame and the inner holding frame, and are disposed on the same axis when the outer holding frame, the middle holding frame and the inner holding frame are in a fitted mounting.

Therein, a preferred solution is as follows: the end-surface slots of the outer holding frame and the inner holding frame comprise a large end-surface slot and a small end-surface slot respectively, and the large end-surface slot of the outer holding frame and the small end-surface slot of the inner holding frame are disposed on the same side.

Therein, a preferred solution is as follows: the end-surface slots are U-shaped slots.

Therein, a preferred solution is as follows: the atomizing assembly also comprises an upper cover in a fitted mounting with the smoke duct; the upper cover comprises an upper cover through hole; the heating module is disposed between the upper cover and the holding frame; and the air channel is connected with the flue through the upper cover through hole.

Therein, a preferred solution is as follows: the upper cover comprises an inner plastic pad, which is in a fitted mounting respectively with the heating module and the middle holding frame.

Therein, a preferred solution is as follows: the heating module also comprises connecting terminals disposed at two ends of the ceramic base body, and the heating wire is connected with the connecting terminals and is electrically connected with the outer holding frame and the inner holding frame through the connecting terminals respectively.

Therein, a preferred solution is as follows: the connecting terminals comprise terminal through holes fitted with the hollow micropore structure of the ceramic base body.

The present invention has the advantageous effects that compared with the prior art, with the design of the outer and inner conductive holding frames in the present invention, the heating module is abutted against and electrically connected with the outer and inner holding frames respectively, thereby simplifying the structure of the electronic cigarette atomizer and increasing the stability of the electronic cigarette atomizer; moreover, with the middle holding frame and an inner plastic pad for sealing and isolating the heating module, the tightness of the electronic cigarette atomizer is improved; and the electronic cigarette atomizer is simple in structure and convenient to mount, thereby facilitating full-automatic production and increasing production efficiency.

BRIEF DESCRIPTION OF THE DRAWINGS

The present invention will be further described below with reference to the attached drawings and the embodiments, in which.

DETAILED DESCRIPTION

Preferred embodiments of the present invention will now be described in detail with reference to the attached drawings.

Figure 1:
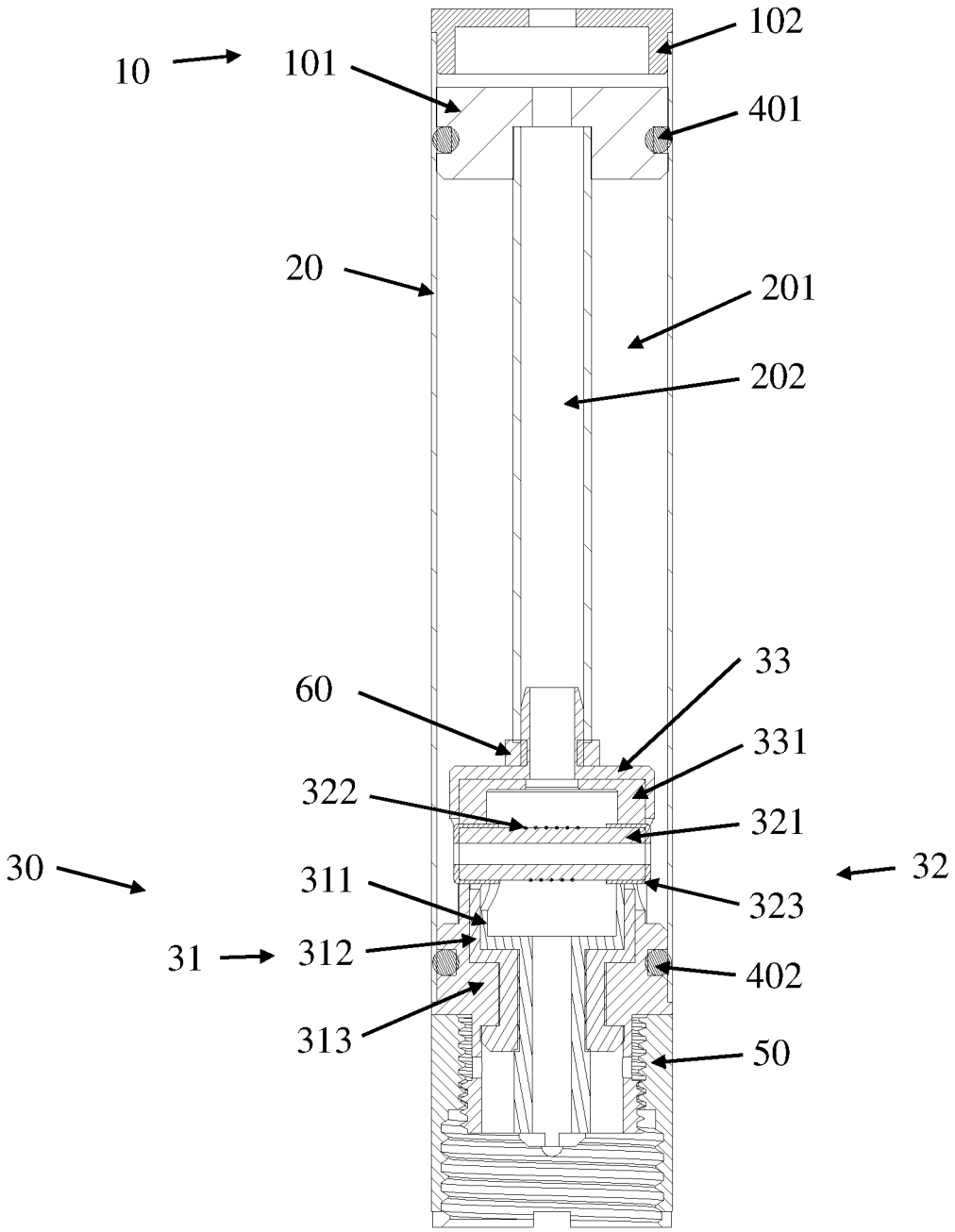
FIG. 1 is a cross-section schematic diagram of an electronic cigarette atomizer of the present invention.
Figure 2:
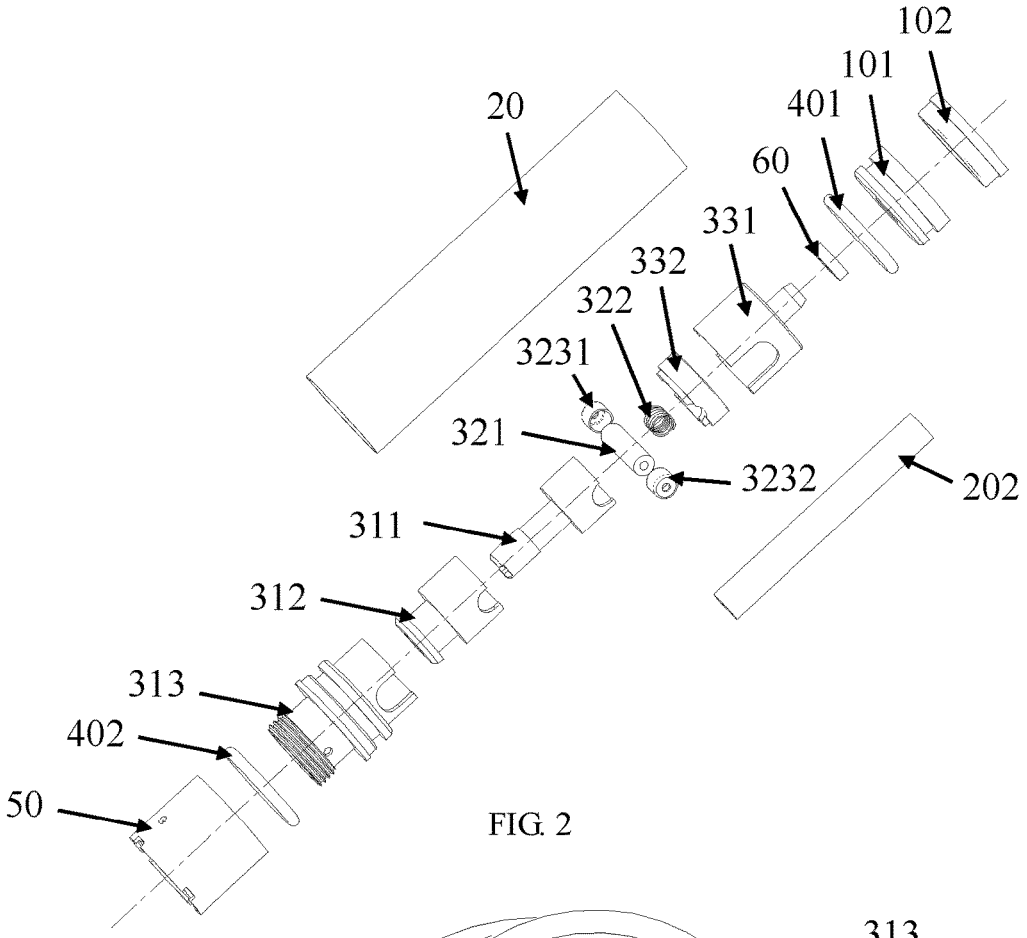
FIG. 2 is an exploded schematic diagram of the electronic cigarette atomizer of the present invention.

As shown in FIG. 1 and FIG. 2, the present invention provides a preferred embodiment of an electronic cigarette atomizer to improve the stability of the electronic cigarette atomizer and facilitate fully-automatic production. Where, FIG. 1 is a cross-section schematic diagram of the electronic cigarette atomizer, and FIG. 2 is an exploded schematic diagram of the electronic cigarette atomizer.

An electronic cigarette atomizer comprises an atomizing assembly 30, a smoke duct 20 and a cigarette holder 10. The smoke duct 20 comprises a liquid storage cavity 201 for storing tobacco liquid and a flue 202, and is in a fitted mounting respectively with the atomizing assembly 30 and the cigarette holder 101. The atomizing assembly 30 comprises a holding frame 31 and a heating module 32. The holding frame 31 comprises an air channel communicated with the flue 202 and end-surface slots for accommodating the heating module 32. The heating module 32 comprises a ceramic base body 321 and a heating wire 322 wound on the ceramic base body. The heating wire 322 is electrically connected with the holding frame 31, and the ceramic base body 321 is of a hollow micropore structure and is communicated with the liquid storage cavity 201.

The ceramic base body 321 is communicated with the liquid storage cavity 201. When a user smokes through the cigarette holder 10, air in the ceramic base body 321 is driven and the tobacco liquid is made to flow into the hollow micropore structure of the ceramic base body 321. Under this state, after the heating wire 322 is energized to heat, the tobacco liquid is heated and atomized into smoke, which passes through the ceramic base body 321 and flows into the air channel to pass through the flue 202 along with the air and flow out at the cigarette holder 10.

The flue 202 is preferably disposed in the center of the smoke duct 20; and an inner side wall of the smoke duct 20 and an outer side wall of the flue 202 form the liquid storage cavity 201, specifically, the inner side wall of the smoke duct 20, the outer side wall of the flue 202, the inner side surface of the cigarette holder 10 and the atomizing assembly 30 form the liquid storage cavity 201.

The cigarette holder 10 comprises a cigarette holder cover 101 and a cigarette holder cap 102, which also comprise cigarette holder ports communicated with the flue 202. The cigarette holder cover 101 is used for sealing the liquid storage cavity 201 and connected with the flue 202. The cigarette holder cover 101 also comprises a lateral groove for sealing a first seal ring 401 to improve the tightness of the liquid storage cavity 201. The cigarette holder cap 102 is made of a plastic material to facilitate smoking.

The electronic cigarette atomizer also comprises an adapter ring 50, which is used for fixing the holding frame 31 and the smoke duct 20, adapting other assemblies of the electronic cigarette atomizer and also wrapping the holding frame 31. The holding frame 31 is used to prevent electric leakage. The adapter ring 50 comprises an air inlet to facilitate smoking.

The air channel mainly refers to a hollow structure consisting of the adapter ring 50 and the holding frame 31. The air channel is communicated with the flue 202, the cigarette holder port and the air inlet, so that the air follows the air inlet into the air channel and drives the smoke which is atomized on the heating module 32 to enter an oral cavity of a human body from the cigarette holder port along the flue 202.

Figure 3:
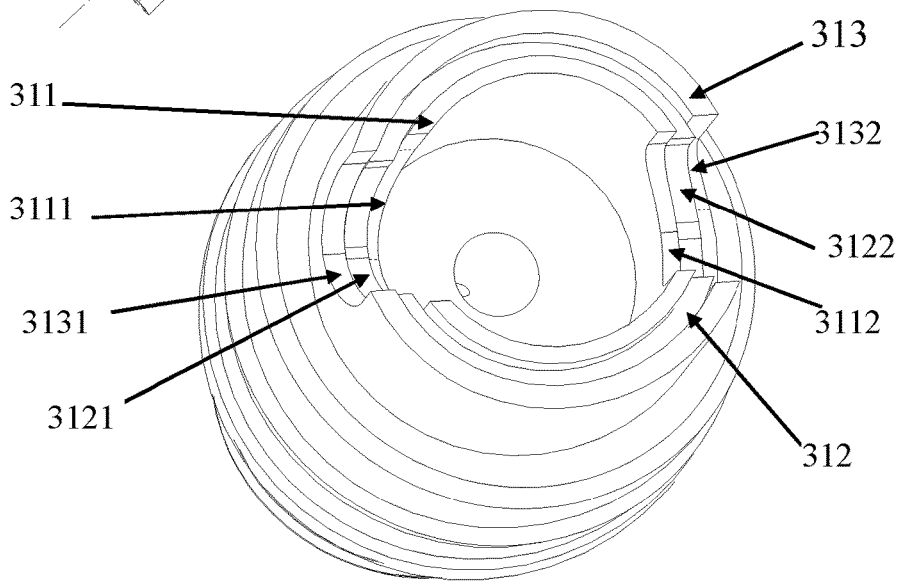
FIG. 3 is a structural schematic diagram of a holding frame of the electronic cigarette atomizer of the present invention.

Further, with reference to FIG. 3, a preferred embodiment of the holding frame 31 is provided. FIG. 3 is a structural schematic diagram of the holding frame of the electronic cigarette atomizer.

The holding frame 31 comprises an outer holding frame 313, a middle holding frame 312 and an inner holding frame 311, which are in a fitted mounting from outside to inside. The outer holding frame 313 and the inner holding frame 311 are conductive holding frames. The middle holding frame 312 is an insulating holding frame and nested between the outer holding frame 313 and the inner holding frame 311 for insulating and isolating the outer holding frame 313 and the inner holding frame 311 and sealing the liquid storage cavity.

Since the outer holding frame 313 and the inner holding frame 311 are conductive, two ends of the heating wire 322 are electrically connected with the outer holding frame 313 and the inner holding frame 311 respectively. The outer holding frame 313 and the inner holding frame 311 are provided with opposite electrodes. For example, a current flows to the heating wire 322 from the outer holding frame 313 and then flows to the inner holding frame 311 from the heating wire 322, whereby the heating wire 322 heats after being energized.

To guarantee the normal flowing of the current and prevent short circuiting, the present invention is implemented by the end-surface slots (3131, 3132, 3121, 3122, 3111, 3112) disposed in the holding frame 31. Specifically, the end-surface slots (3131, 3132), (3121, 3122), (3111, 3112) are respectively disposed at two sides of an end-surface for the outer holding frame 313, the middle holding frame 312 and the inner holding frame 311. The end-surface is a side surface for accommodating the heating module 32. Since the heating module 32 takes the shape of a cylinder, the end-surface slots (3131, 3132, 3121, 3122, 3111, 3112) are disposed on the same axis when the outer holding frame 313, the middle holding frame 312 and the inner holding frame 311 are in a fitted mounting. Naturally, if the heating module 32 takes other shapes, the end-surface slots (3131, 3132, 3121, 3122, 3111, 3112) are disposed at corresponding positions.

Further, the end-surface slots of the outer holding frame 313 and the inner holding frame 311 comprise a large end-surface slot 3132, 3111 and a small end-surface slot 3131, 3112 respectively. The large end-surface slot 3132 of the outer holding frame 313 and the small end-surface slot 3112 of the inner holding frame 311 are disposed on the same side. When the heating module 32 is placed on the holding frame 31, at one side surface in which the large end-surface slot 3132 of the outer holding frame 313 and the small end-surface slot 3112 of the inner holding frame 311 are disposed. The ceramic base body 321 is clamped and sleeved on the small end-surface slot 3112 of the inner holding frame 311. The heating wire 322 is electrically connected with the inner holding frame 311. But, the large end-surface slot 3132 of the outer holding frame 313 cannot be connected with the ceramic base body 321. The heating wire 322 is not electrically connected with the outer holding frame 313; and similarly. The heating wire 322 at the other side is connected with the outer holding frame 313. Namely, one end of the heating wire 322 is electrically connected with the outer holding frame 313, and the other end is electrically connected with the inner holding frame 311 to form an energization circuit.

To facilitate the production and mounting of the heating module 32 and realize automatic mounting, the end-surface slots are preferably U-shaped slots.

The outer holding frame 313 also comprises a threaded structure for fitted connection with an adapter ring 50, a lateral groove for mounting a second seal ring 402 to improve the tightness of the liquid storage cavity 201. The outer holding frame 313 is in a fitted mounting respectively with the adapter ring 50 to support the inner holding frame 312 and the inner holding frame 311.

Figure 4:
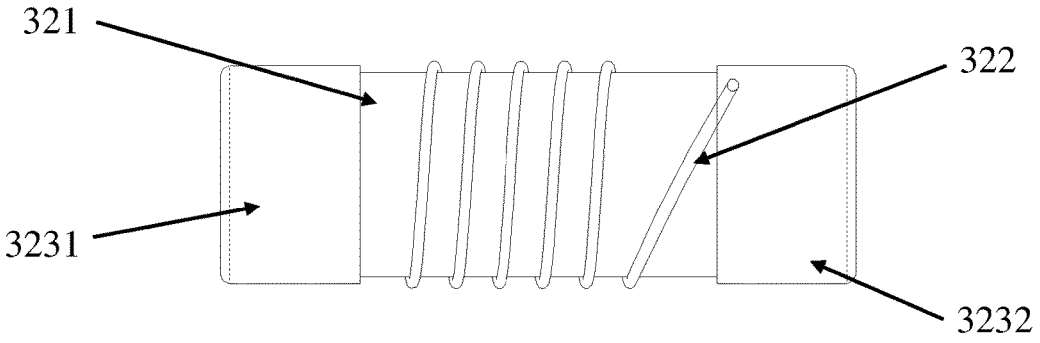
FIG. 4 is a structural schematic diagram of a heating module of the electronic cigarette atomizer of the present invention.
Figure 5:
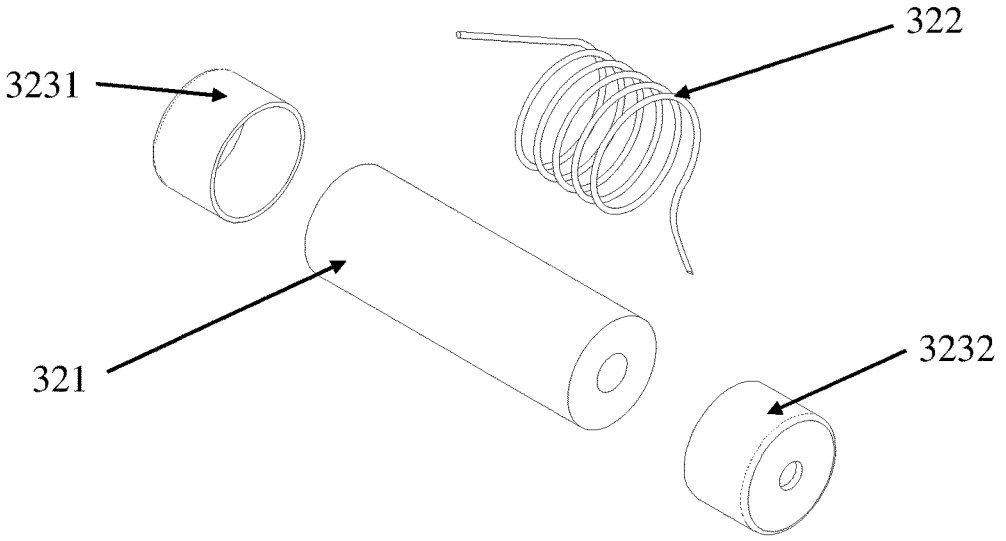
FIG. 5 is an exploded schematic diagram of the heating module of the electronic cigarette atomizer of the present invention.

With reference to FIG. 4 and FIG. 5, a preferred embodiment of a heating module is provided. FIG. 4 is a structural schematic diagram of the heating module of the electronic cigarette atomizer, and FIG. 5 is an exploded schematic diagram of the heating module of the electronic cigarette atomizer.

The heating module 32 also comprises connecting terminals 323 disposed on two ends of the ceramic base body 321. The connecting terminals 323 comprise a first connecting terminal 3231 and a second connecting terminal 3232, which are disposed at two sides. The ceramic base body 321 is abutted against the end-surface slots through the connecting terminals 323. The connecting terminals 323 are conductors. The heating wire 322 is connected with the connecting terminals 323 and is electrically connected with the outer holding frame 313 and the inner holding frame 311 through the connecting terminals 323 respectively.

The connecting terminals 323 comprise terminal through holes fitted with the hollow micropore structure of the ceramic base body 321. The hollow micropore structure of the ceramic base body 321 is communicated with the liquid storage cavity 201 through the connecting terminals 323.

Figure 6:
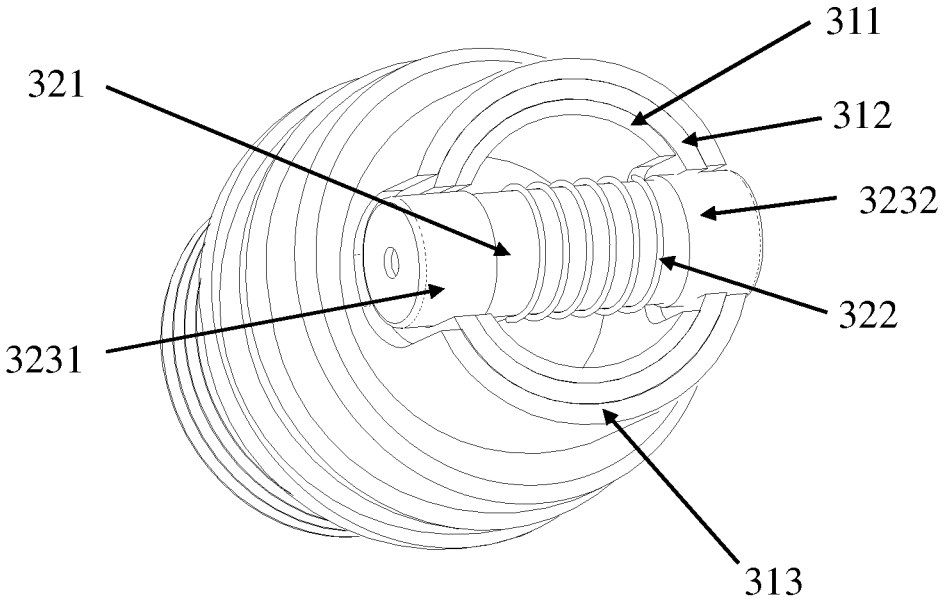
FIG. 6 is a structural schematic diagram of the holding frame and heating module of the electronic cigarette atomizer of the present invention.

As shown in FIG. 6, the present invention provides a preferred embodiment for the mounting of the holding frame and heating module. FIG. 6 is a structural schematic diagram of the holding frame and heating module of the electronic cigarette atomizer.

When the heating module 32 is placed on the holding frame 31, the first connecting terminal 3231 is connected with the small end-surface slot of the inner holding frame 311 and is energized with the inner holding frame 311, and the second connecting terminal 3232 is connected with the small end-surface slot of the outer holding frame 313 and is energized with the outer holding frame 313.

In the present invention, the atomizing assembly 30 also comprises an upper cover 33 in a fitted mounting with the smoke duct 20. The upper cover 33 comprises an upper cover through hole; the heating module 32 is disposed between the upper cover 33 and the holding frame 31. The air channel is connected with the flue 202 through the upper cover through hole.

The upper cover 33 comprises an inner plastic pad 331, which is in a fitted mounting with the heating module 32 and the middle holding frame 312 respectively. An end section of the upper cover 33 is provided with a U-shaped slot fitted with the heating module 32 and the middle holding frame 312.

The end section of the upper cover 33 is in a fitted mounting with the flue 202, and is locked and sealed through an O-shaped gasket 60 to prevent the tobacco liquid from flowing backward.

In the present invention, an assembling process of the electronic cigarette atomizer is approximately as follows: first, the heating wire 322 is wound on the ceramic base body 321; next, the connecting terminals 323 are connected onto the ceramic base body 321; then the ceramic base body 321 together with the heating wire 322 and the connecting terminals 323 are mounted into the two end-surface slots of the holding frame 31 which is obtained by nesting the outer holding frame 313, the middle holding frame 312 and the inner holding frame 311. A power supply is mounted on the outer holding frame 313 and the inner holding frame 311 and is connected with the heating wire 322 (through the connecting terminals 323); and then, the upper cover 33. The smoke duct 20, the cigarette holder cover 101 and the adapter ring 50 are mounted to complete the mounting operation. An assembling sequence of the electronic cigarette atomizer may also be appropriately adjusted as required to facilitate the implementation of the full-automatic production. The description above shall not be construed as limiting the scope of the present invention but as merely providing preferred embodiments of the present invention. Any equivalent variations or modifications made based on the present invention application shall be encompassed by the present invention.

What is claimed is:

1. An electronic cigarette atomizer, comprising:

an atomizing assembly, a smoke duct, and a cigarette holder, wherein the smoke duct comprises a liquid storage cavity for storing tobacco liquid and a flue; the smoke duct is cooperatively mounted respectively with the atomizing assembly and the cigarette holder, wherein the atomizing assembly comprises: a holding frame, comprising an air channel communicated with the flue and end-surface slots for accommodating a heating module; and the heating module, comprising a ceramic base body and a heating wire wound on the ceramic base body, wherein the heating wire is electrically connected with the holding frame, and the ceramic base body is of a hollow micropore structure and is communicated with the liquid storage cavity;

wherein the holding frame comprises an outer holding frame, a middle holding frame and an inner holding frame, the outer holding frame and the inner holding frame are conductive holding frames, and the middle holding frame is an insulating holding frame and nested between the outer holding frame and the inner holding frame for insulating and isolating the outer holding frame and the inner holding frame and sealing the liquid storage cavity; and wherein the end-surface slots of the outer holding frame and the inner holding frame comprise a large end-surface slot and a small end-surface slot respectively, and the large end-surface slot of the outer holding frame and the small end-surface slot of the inner holding frame are disposed on a same side.

2. The electronic cigarette atomizer according to claim 1, wherein two ends of the heating wire are electrically connected with the outer holding frame and the inner holding frame respectively, and the outer holding frame and the inner holding frame are provided with opposite electrodes.

3. The electronic cigarette atomizer according to claim 2, wherein the end-surface slots are respectively disposed at two sides of an end-surface of the outer holding frame, the middle holding frame and the inner holding frame; and the end-surface slots are disposed on a same axis when the outer holding frame, the middle holding frame and the inner holding frame are cooperatively mounted.

4. The electronic cigarette atomizer according to claim 2, wherein the end-surface slots are U-shaped slots.

5. The electronic cigarette atomizer according to claim 3, wherein the end-surface slots are U-shaped slots.

6. The electronic cigarette atomizer according to claim 1, wherein the end-surface slots are U-shaped slots.

7. The electronic cigarette atomizer according to claim 1, wherein the atomizing assembly further comprises an upper cover in a fitted mounting with the smoke duct; the upper cover comprises an upper cover through hole; the heating module is disposed between the upper cover and the holding frame; and the air channel is connected with the flue through the upper cover through hole.

8. The electronic cigarette atomizer according to claim 7, wherein the upper cover comprises an inner plastic pad, which is in a fitted mounting respectively with the heating module and the middle holding frame.

9. The electronic cigarette atomizer according to claim 1, wherein the heating module further comprises connecting terminals disposed at two ends of the ceramic base body; the heating wire is connected with the connecting terminals and is electrically connected with the outer holding frame and the inner holding frame respectively through the connecting terminals.

10. The electronic cigarette atomizer according to claim 9, wherein the connecting terminals comprise terminal through holes fitted with the hollow micropore structure of the ceramic base body.

* * * * *